US006406215B1

(12) United States Patent
Balve et al.

(10) Patent No.: US 6,406,215 B1
(45) Date of Patent: Jun. 18, 2002

(54) POSITIVE CONNECTION BETWEEN A PIPE AND A RING INSERTED INTO THE PIPE

(75) Inventors: Gerhard Balve; Franz-Josef Püttmann, both of Lennestadt (DE)

(73) Assignee: Tracto-Technik Paul Schmidt Spezialmaschinen, Lennestadt (DE)

( * ) Notice: Subject to any disclaimer, the term of this patent is extended or adjusted under 35 U.S.C. 154(b) by 0 days.

(21) Appl. No.: 09/343,812

(22) Filed: Jun. 30, 1999

(30) Foreign Application Priority Data

Jul. 8, 1998 (DE) ..... 198 30 428

(51) Int. Cl.[7] ..... B25G 3/00
(52) U.S. Cl. ..... 403/383; 403/294; 285/305
(58) Field of Search ..... 403/383, 294, 403/348, 350; 285/305, 308

(56) References Cited

U.S. PATENT DOCUMENTS 4,361,196 A * 11/1982 Hoyle, Jr. ..... 175/320
4,632,195 A * 12/1986 Emmerich ..... 175/320
5,141,350 A * 8/1992 Hecke ..... 403/15
5,148,718 A * 9/1992 Kakuguchi et al. ..... 74/553
6,186,694 B1 * 2/2001 Couallier et al. ..... 403/225

* cited by examiner

*Primary Examiner*—Teri Pham Luu
(74) *Attorney, Agent, or Firm*—Gary W. McFarron, Esq.; Cook, Alex, McFarron, Manzo, Cummings & Mehler

(57) ABSTRACT

A positive connection between a pipe and a ring inserted into the pipe, in particular between the housing of a ram boring device and a stop ring inserted into the housing, wherein the inside wall of the pipe has a convex groove consisting of a section of a surface of a sphere and the ring has a corresponding convex outer surface with the same radius, the inside wall of the pipe possessing at least one axial groove permitting insertion into the pipe or the outer surface of the ring possessing at least one flattened portion permitting insertion into the pipe, or the ring being axially divided into two or more preferably unequal segments.

14 Claims, 6 Drawing Sheets

POSITIVE CONNECTION BETWEEN A PIPE AND A RING INSERTED INTO THE PIPE

Figure 1:
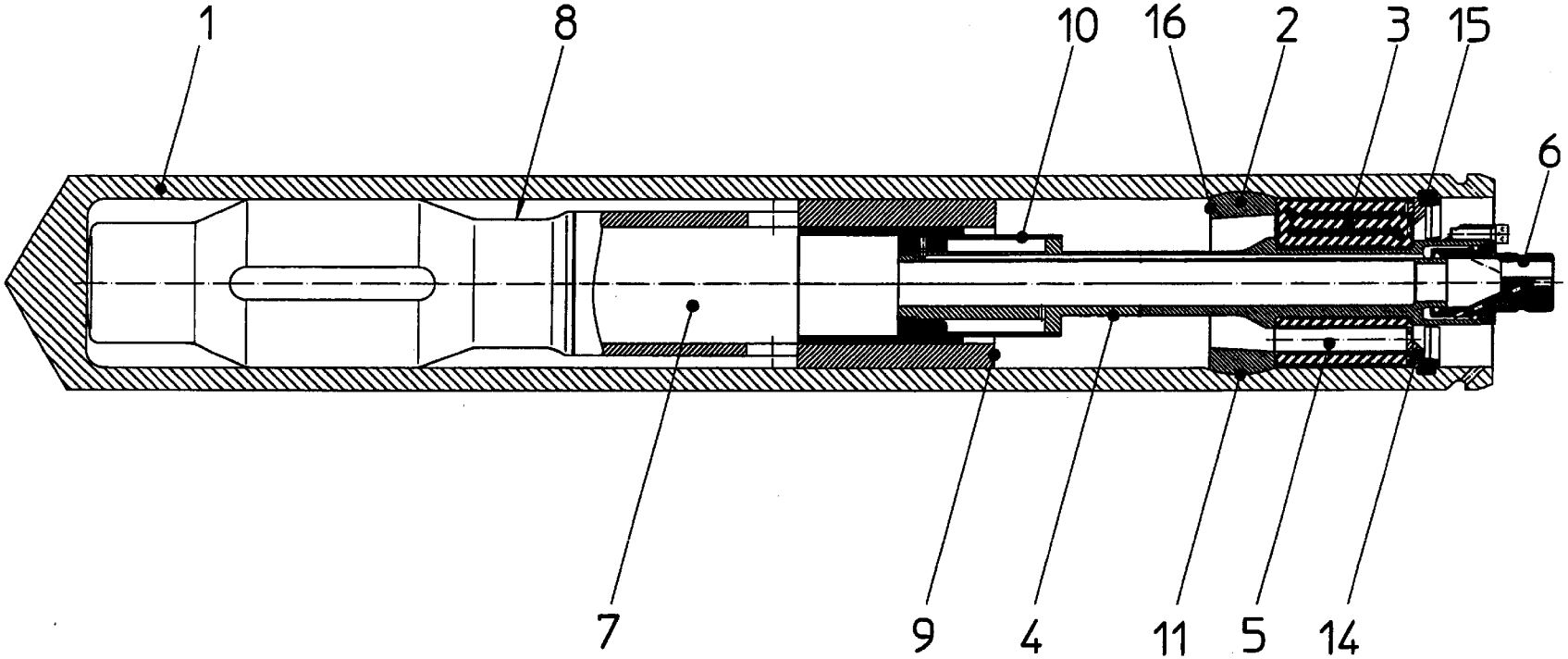

The invention relates to a positive connection between a pipe and a ring inserted into the pipe, in particular a positive connection between a tubular housing of a ram boring device and a stop ring inserted into the housing.

Positive connections between a pipe and a ring can be achieved, for example, by screwing or inserting a ring which is resiliently compressible radially into an annular groove of the pipe or, according to German Patent Specification 4,231,400, by inserting annular segments into an annular groove.

In the case of ram boring devices which possess a switch control from forward operation to reverse operation, the switch control is effected in that the percussion piston is braked at a forward reversing point, essentially without transmitting its kinetic energy to the device housing, with the aid of the operating air, and the rear dead center position is displaced backward. In the rear dead center position, provision is made for the percussion piston to discharge its kinetic energy, for example, against a rearward stop ring. In a ram boring device described in German Published Application 196 17 603, this stop ring is screwed into the rear end of the housing of the ram boring device and serves as a support for a control pipe projecting into a percussion piston chamber of the percussion piston and a control sleeve arranged concentrically thereto.

The screwing in and out of the stop ring, which is necessary in order to exchange wearing parts in the ram boring device, is time-consuming, since the thread is relatively long and is usually secured against unintentional loosening by an adhesive in the thread, which has to be destroyed by heating in order to break the connection.

The positive connections of the type mentioned initially between a pipe and a ring inserted into the pipe also exhibit these disadvantages. An additional factor in the case of ram boring devices is that the stop ring, in reverse operation, receives the ram impacts of the percussion piston and transmits them to the housing, for which reason it must consist of a material of adequate strength. Even so, it does happen that the stop ring breaks in the region of the thread.

The object of the invention is to provide a positive connection between a pipe and a ring inserted into the pipe, in particular between the tubular housing of a ram boring device and a stop ring inserted into the housing, which can be assembled and dismantled simply and is tolerant of high impact stresses.

Starting from this statement of the problem, the invention proposes a positive connection between the pipe and the ring inserted into the pipe, wherein the inside wall of the pipe possesses a groove in the form of a section of a surface of a sphere and the ring possesses a complementary outer surface, the inside wall of the pipe possessing at least one axial groove permitting insertion of the stop ring into the pipe or the outer surface of the ring possessing at least one flattened portion permitting insertion into the pipe, or the ring being divided axially into at least two preferably unequal segments.

In one embodiment, two flattened portions may be provided on the ring, lying diametrically opposite one another, and may be rounded to a radius corresponding to the radius of the inner surface of the pipe.

Assembly is possible in that the ring is pushed into the pipe parallel to the axis of the pipe when the flattened portion or portions, extending in the direction of the axis of the pipe, rest on the inner surface of the pipe, until the ring is located in the region of the groove which is, for example, convex in cross section. If the ring is now twisted through 90°, so that its plane stands perpendicularly to the axis of the pipe, the ring with its likewise convex outer surface fits positively into the convex groove of the pipe. Axial forces and the ram impacts of the percussion piston during a reverse movement of the device are transmitted by the convex outer surface of the ring, with the exception of the flattened portions, to the surface of the convex groove, and this takes place all the more effectively the more closely the ring with its convex outer surface is fitted into the convex groove.

If the ring has no flattened portions, but if an axial groove or two axial grooves lying diametrically opposite one another are arranged in the inside wall of the pipe, assembly takes place in exactly the same manner.

If, for example, the pipe is warmed or the ring cooled before the insertion of the ring, so that they can be brought together with sufficient assembly play, the cooling of the pipe or the warming of the ring in the assembled position can result in a clamping fit, so that the ring can no longer change its position. Similarly, a groove for a conventional snap ring can be arranged on one or both sides of the ring, so that tilting of the ring is no longer possible after the insertion of the snap ring.

The ring may also be axially prestressed with the aid of an elastic block or by means of screws, so that in forward operation, despite a slight axial play, it is fixedly secured between the housing groove and the ring.

The positive connection according to the invention is particularly suitable for arranging a stop ring in the tubular housing of a ram boring device. This stop ring receives the impacts of the percussion piston during reverse operation and passes them onto the housing.

Figure 2:
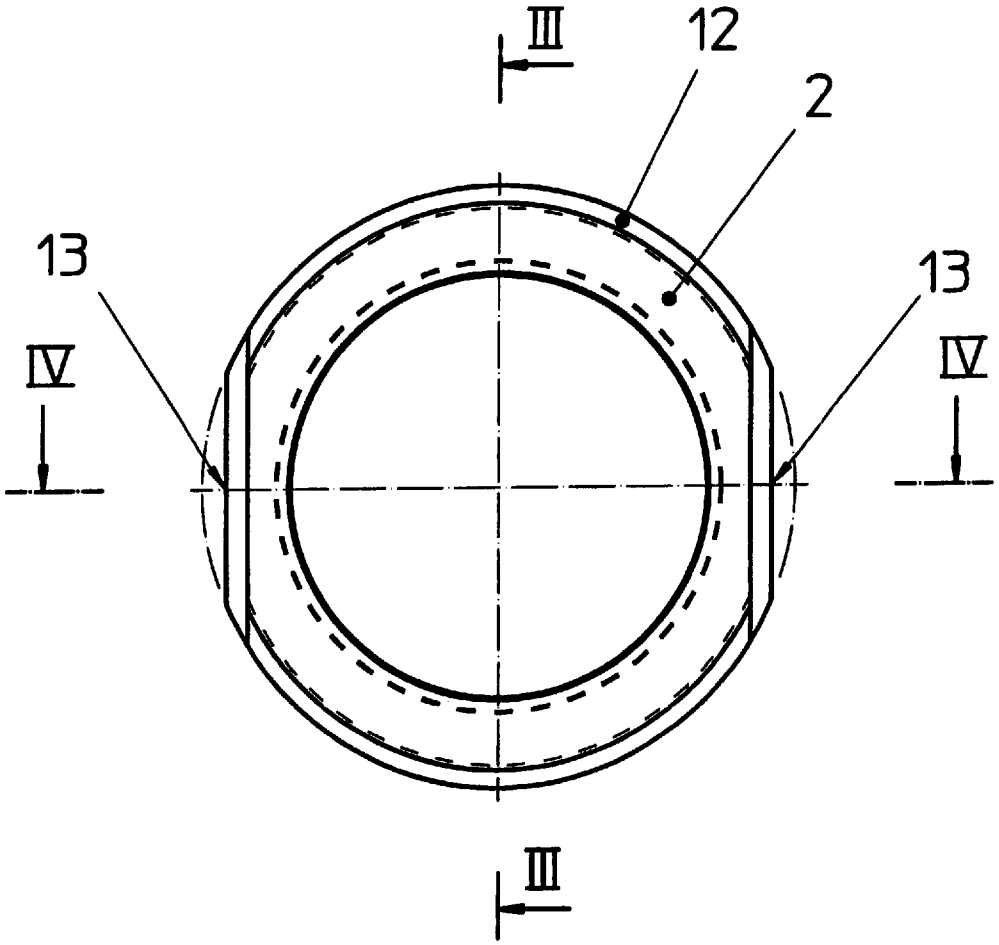
Figure 3:
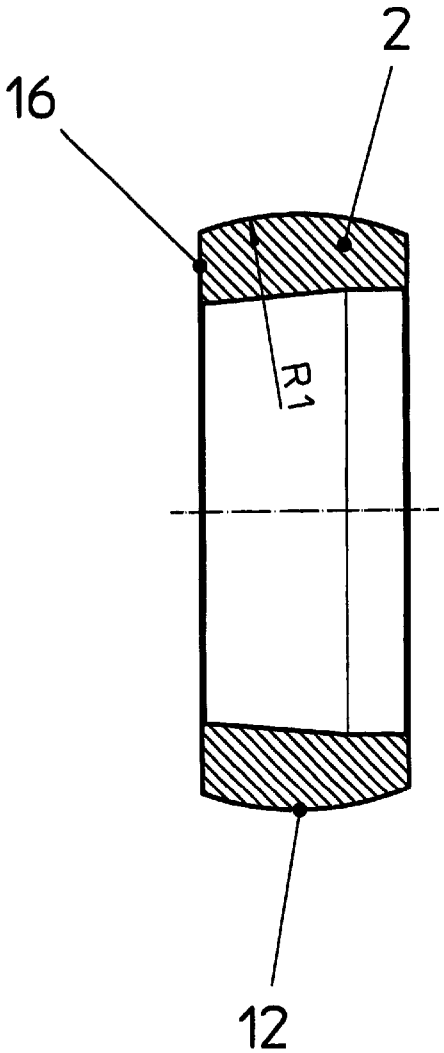
Figure 4:
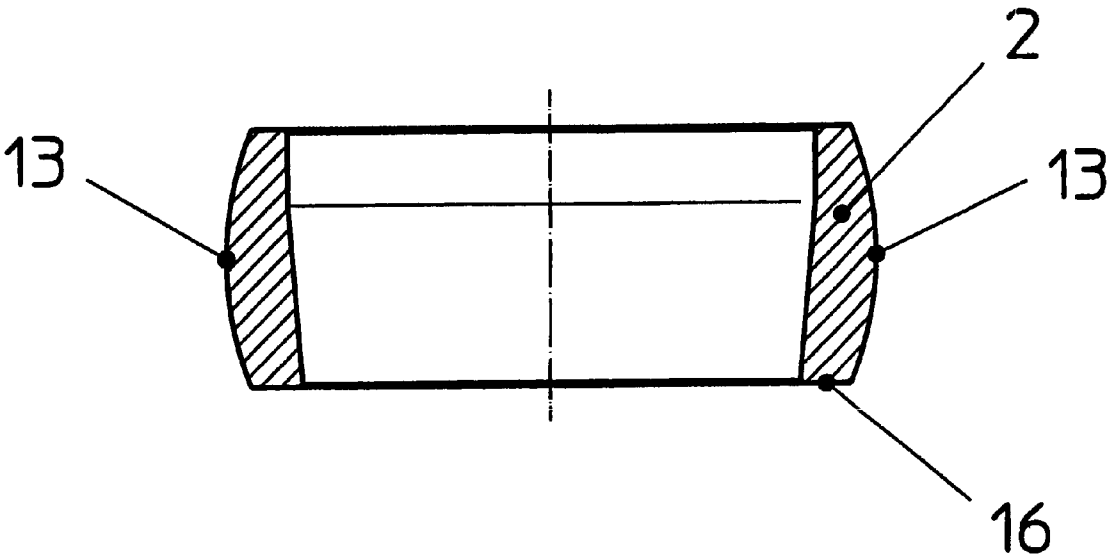
Figure 6:
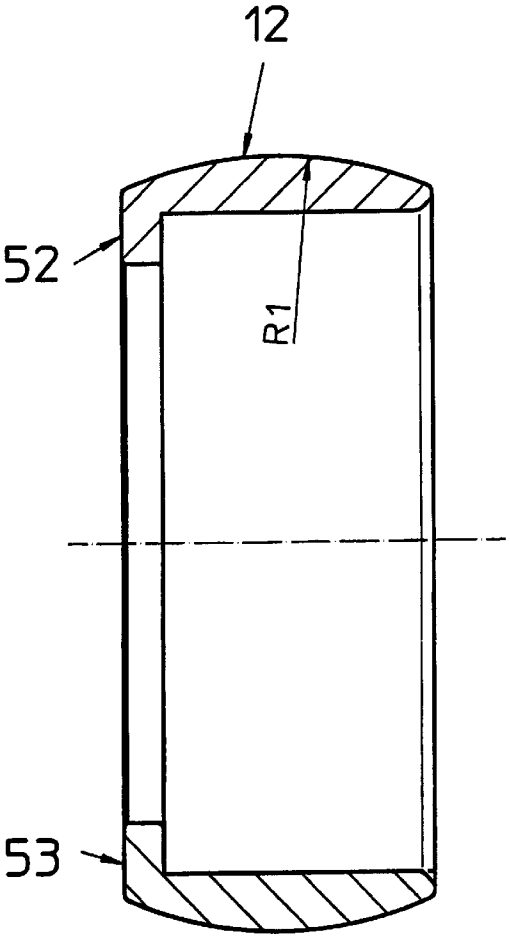
Figure 5:
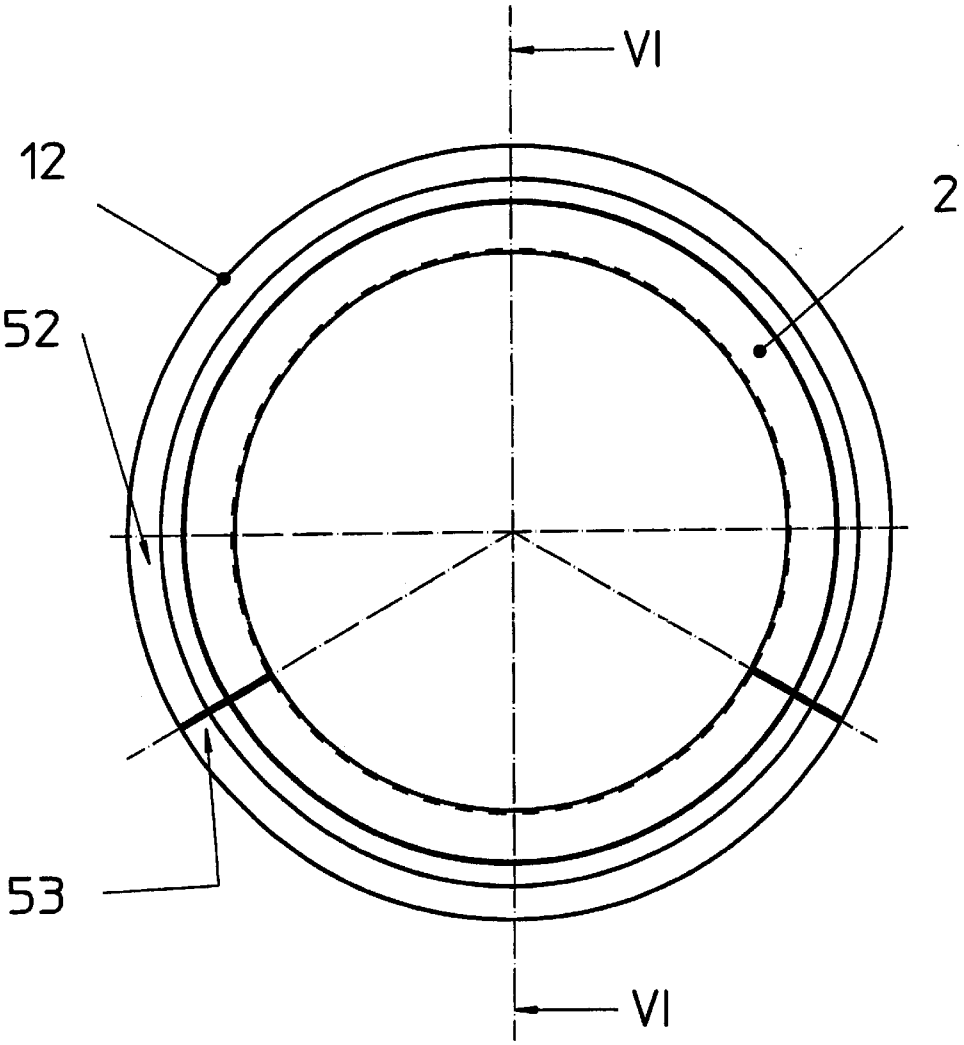
Figure 7:
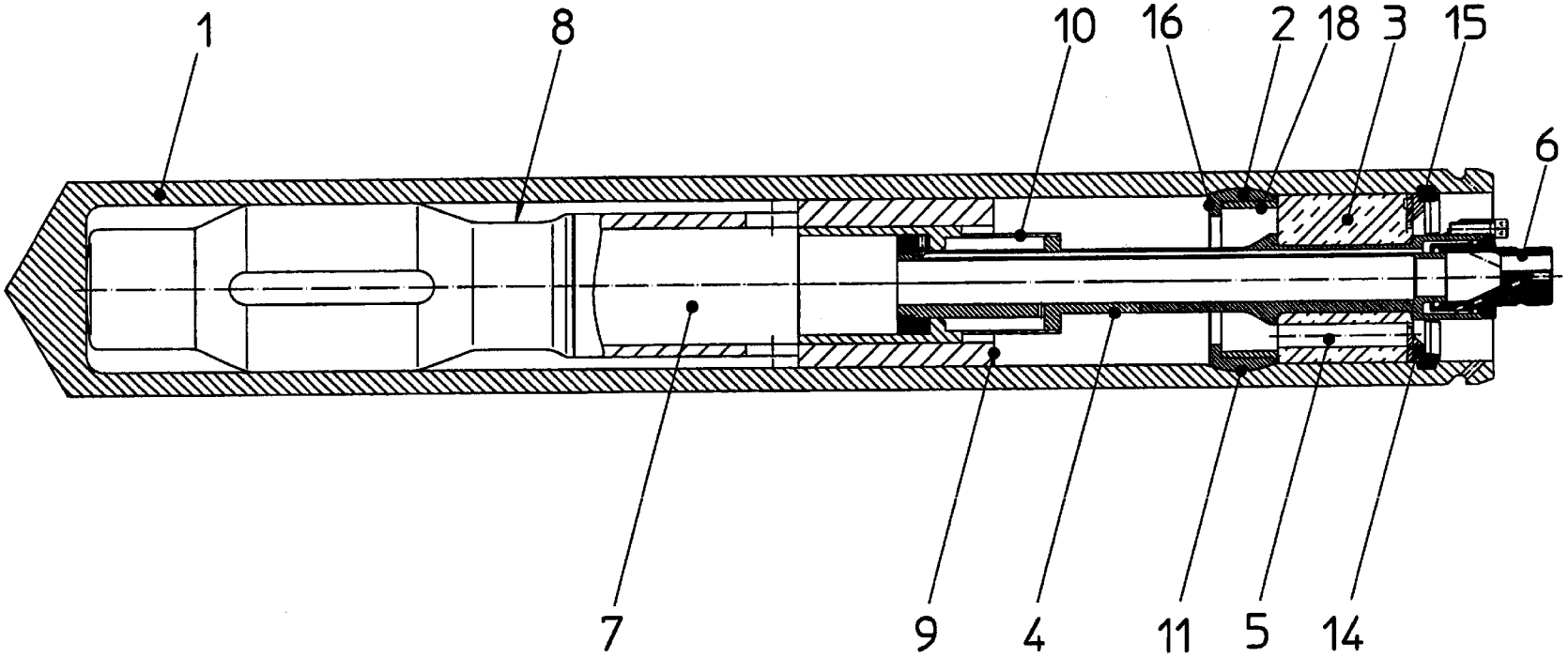

The invention is explained in detail below with reference to an example of embodiment shown in the drawing. In the drawing:

FIG. 1 shows a lengthwise section through a ram boring device with a stop ring, FIG. 2 shows a front view of the stop ring, FIG. 3 shows a section through the stop ring along the line III—III in FIG. 2, FIG. 4 shows a section through the stop ring along the line IV—IV in FIG. 2, FIG. 5 shows another embodiment of the stop ring, FIG. 6 shows a section through the stop ring along the line VI—VI in FIG. 5, FIG. 7 shows a lengthwise section through the ram boring device with stop ring according to FIG. 5.

A ram boring device is, viewed from the angle of its structural and working principle, constructed in the same way as the ram boring device described in German Published Application 196 17 603. It consists of a tubular housing 1, in whose rearward part a stop ring 2 is arranged. The stop ring 2 has a convex outer surface 12, which forms a section of a surface of a sphere having a radius $R_1$. The stop ring 2 is arranged in a groove 11 of the housing 1 of the ram boring device. This groove 11 is likewise convex, having a shape designed as a section of the surface of a sphere with the same radius $R_1$. The stop ring 2 can thus turn in the convex groove 11 about an axis perpendicular to the axis of the housing 1. The stop ring 2 is prevented from turning in this manner by a mounting 3, which is retained in the housing 1 by means of a support ring 14 and a snap ring 15. Exit air ducts 5 for the operating air extend through the mounting 3. Furthermore, the mounting 3 serves to retain and guide a control pipe 4, extending into a chamber 7 of a percussion piston 8, and a control sleeve 10, which interact, for example, in the manner described in German Published Application 196 17 603, in order to effect switching of the ram boring device from forward operation to reverse operation. Whereas during forward operation the percussion piston 8 impacts with its front end on an impact surface of the housing 1, its movement is controlled during reverse operation by the control pipe 4 and the control sleeve 10 in a manner such that it impacts with its rear surface 9 on a stop surface 16 of the stop ring 2. The operating air necessary for the reciprocal movement of the percussion piston 8 is fed via an operating air hose 6 beginning at the rear end of the control pipe 4.

The stop ring 2 possesses flattened portions 13 lying diametrically opposite one another, which are rounded to a radius $R_1$ in the manner shown in FIG. 4, this radius corresponding to the internal radius of the housing 1. The stop ring 2 can thus be pushed into the housing if it is twisted so that the flattened portions 13 lie on the inner surface of the housing 1, parallel to the axis. When the stop ring 2 is pushed sufficiently far into the housing to be located in the region of the convex groove 11, the stop ring 2 can be twisted through 90° into the position shown in FIG. 1 and now lies with its convex outer surface 12 in close contact with the inner surface of the convex groove 11; it is then axially fixed. In this position the stop ring 2 can readily transmit to the housing 1 the impacts which the percussion piston 8 produces with its rear surface 9 on the stop surface 16 of the stop ring 2 during reverse operation, without this having repercussions on the mounting 3 and its fixing in the housing 1 by means of the support ring 14 and of the snap ring 15. Similarly, the risk of a fatigue fracture in the region of the convex groove 11 is slight, since the latter is rounded so that no stress peaks arise.

If the mounting 3 consists of an elastic block, the stop ring 2 can be axially prestressed without rebound impacts being transmitted to the control pipe 4 and the control sleeve 10.

In another embodiment, the stop ring 2 possesses no flattened portions 13, but is divided axially preferably into two unequal segments 52, 53.

As a result of the division into at least two segments, the stop ring 2 can be introduced into the pipe even without flattened portions.

In a preferred embodiment, the segments 52, 53 are divided in the ratio of two-thirds to one-third. For assembly, the larger segment 52 is initially introduced into the pipe and can then be twisted through 90° in the region of the sphere surface. In the next step, the smaller segment 53 is then introduced accordingly. To simplify assembly, the ends of the segment may be shortened, so that the ring is not closed in the installed state. In order to retain the stop ring 2 stably in the groove 11, the latter has a supporting sleeve 18.

In a further embodiment, the stop ring 2 is designed cylindrically in respect of its outer surface and possesses an axial stop surface in the housing of the ram boring device.

Preferably, the stop ring 2 is prestressed by an elastic block.

The invention can be used in the manner described for any positive connection between a pipe and a ring inserted into the pipe and offers the advantage of simple and rapid assembly and dismantling. Instead of flattened portions on the ring, axial grooves may be provided in the pipe in order to permit insertion as far as the region of the peripheral groove.

What is claimed is:

1. Positive connection between a pipe (1) and a ring (2) inserted into the pipe (1), wherein the inside wall of the pipe (1) possesses a groove (11) and the ring (2) possesses a complementary outer surface (12), and the inside wall of the pipe (1) possesses at least one axial groove permitting insertion into the pipe or the outer surface of the ring (2) possesses at least one flattened portion permitting insertion into the pipe (1), or the ring comprises at least two arc segments (52, 53) sized to permit insertion of each segment into the pipe.

2. The connection as claimed in claim 1, wherein the ring (2) possesses two flattened portions (13) lying diametrically opposite one another.

3. The connection as claimed in claim 1, wherein the at least one flattened portion (13) is rounded to a radius corresponding to the radius of the inner surface of the pipe.

4. The connection as claimed in claim 1 further comprising a percussion piston (8) reciprocally moved within the pipe (1), a control pipe (4) projecting into a percussion piston chamber (7), a mounting (3) for the control pipe (4) arranged on the pipe (1), the ring (2) being arranged in front of the mounting (3), and including an outer surface (12) of convex cross section for cooperation with the complementary groove (11) and possessing on its periphery the at least one flattened portion (13) permitting insertion into the housing (1).

5. The connection as claimed in claim 4, wherein the ring (2) possesses two flattened portions (13) lying diametrically opposite one another.

6. The connection as claimed in claim 4, wherein the flattened portion (13) is rounded to a radius corresponding to the radius of the inner surface of the pipe.

7. The connection as claimed in claim 1, wherein the ring (2) is axially tensioned against the pipe (1).

8. The connection as claimed in claim 1, wherein the ring (2) possesses a cylindrical outer surface and the complementary groove (11) has an even surface.

9. The connection as claimed in claim 1, wherein the ring 2 is divided into at least two segments (52; 53).

10. The connection as claimed in claim 9, wherein the ring (2) is divided into two segments, the arc extent of the segments (52; 53) having a ratio of 2 to 1.

11. The connection as claimed in claim 9, wherein the ends of the segments (52; 53) are shortened.

12. The connection as claimed in claim 1, wherein the ring (2) possesses a support sleeve (18).

13. The connection as claimed in claim 1, wherein the ring (2) is prestressed.

14. The connection as claimed in claim 13, wherein the prestress is provided by an elastic block.

* * * * *